US009409423B1

(12) United States Patent
Seng et al.

(10) Patent No.: US 9,409,423 B1
(45) Date of Patent: Aug. 9, 2016

(54) PRINTER APPARATUS

(71) Applicant: TOSHIBA TEC KABUSHIKI KAISHA, Shinagawa-ku, Tokyo (JP)

(72) Inventors: Ooi In Seng, Singapore (SG); Toshiharu Sekino, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/788,973

(22) Filed: Jul. 1, 2015

(51) Int. Cl.
*B41J 11/66* (2006.01)
*B41J 11/70* (2006.01)

(52) U.S. Cl.
CPC ..... *B41J 11/663* (2013.01); *B41J 11/66* (2013.01); *B41J 11/70* (2013.01); *B41J 11/706* (2013.01)

(58) Field of Classification Search
CPC ..... B41J 11/663; B41J 11/706; B41J 11/70; B41J 11/66
USPC ..... 347/220, 157, 104
See application file for complete search history.

(56) References Cited

U.S. PATENT DOCUMENTS 6,508,600 B1 * 1/2003 Nonaka ..... B26D 1/085 101/227
7,986,420 B2 * 7/2011 Harris ..... B41J 11/006 347/104
2006/0119671 A1 * 6/2006 Ha ..... B41J 2/17509 347/84

FOREIGN PATENT DOCUMENTS

JP 2009-137278 6/2009
JP 2014-166908 9/2014

* cited by examiner

*Primary Examiner* — Henok Legesse
(74) *Attorney, Agent, or Firm* — Amin, Turocy & Watson LLP

(57) ABSTRACT

In accordance with one embodiment, a printer apparatus comprises a main body section configured to include a first printer cover; an opening and closing unit configured to include a second printer cover which is fixed to be rotatable with respect to the main body section; a fixed blade configured to be held by the main body; a movable blade configured to be held by the opening and closing unit to cut paper through the cooperation with the fixed blade; a home position sensor configured to detect a home position of the movable blade; and a third printer cover configured to constitute one part of the first printer cover, and retract to a retracting position so as not to contact with the movable blade which is not positioned at the home position when the opening and closing unit is opened.

4 Claims, 5 Drawing Sheets

PRINTER APPARATUS

FIELD

Embodiments described herein relate generally to a printer apparatus which carries out printing on paper and then issues the printed paper.

BACKGROUND

In a printer apparatus used as a receipt issuing apparatus and the like, pre-determined items are printed on long-sized roll paper drawn out from the paper wound into a roll shape, and then the long-sized roll paper is cut into a sheet having a pre-determined length by a cutter and then issued.

When the roll paper is used up, an operator of the printer apparatus replenishes the printer apparatus with new roll paper. During the paper replenishment, a cover of the printer apparatus is opened to carry out the paper replenishment, and the wider the opening section is, the easier the replenishment is. Thus, there is known a printer apparatus which opens the opening section with a fixed blade of a cutter for cutting roll paper arranged at the cover side and a movable blade arranged at the fixed side. The movable blade of the cutter is separated from the fixed blade when the cover is opened, thus, the blade part of the cutter is exposed to the outside when the cover is opened. Thus, to prevent the blade part of the cutter from being damaged by a falling object and the like, there is known a protrusion arranged nearby the cutting edge of the fixed blade to protect the blade part. The cutter, when cutting the roll paper, moves the movable blade towards the fixed blade; however, there is a case in which poor cutting or roll paper jam occurs during the cutting process. In a case in which the printer apparatus is stopped due to paper jam and the like during the cutting process, the movable blade is in a state of protruding towards the fixed blade. If the cover of the printer apparatus is opened in this state, there is a risk that the movable blade of the cutter contacts with a cover and the like at the base side of the printer apparatus, which may cause damage in the movable blade.

DETAILED DESCRIPTION

In accordance with one embodiment, a printer apparatus comprises a main body section configured to include a first printer cover; an opening and closing unit configured to include a second printer cover which is fixed to be rotatable with respect to the main body section; a fixed blade configured to be held by the main body; a movable blade configured to be held by the opening and closing unit to cut paper through the cooperation with the fixed blade; a home position sensor configured to detect a home position of the movable blade; and a third printer cover configured to constitute one part of the first printer cover, and retract to a retracting position so as not to contact with the movable blade which is not positioned at the home position when the opening and closing unit is opened.

Hereinafter, the printer apparatus according to the present embodiment is described in detail with reference to the accompanying drawings.

Figure 1:
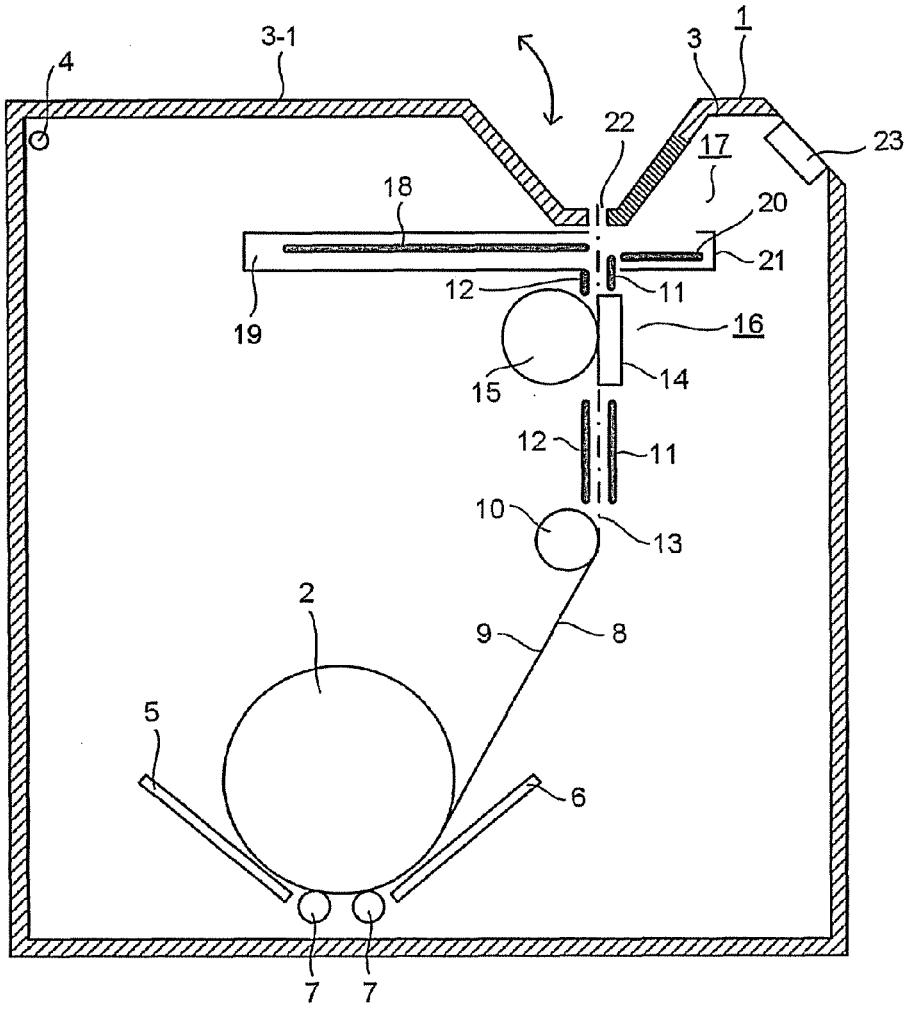
FIG. 1 is a constitution diagram illustrating the main portions of a printer apparatus according to one embodiment.

FIG. 1 is a constitution diagram illustrating the main portions of a printer apparatus 1 according to the present embodiment. In the printer, the paper is conveyed from the lower side towards the upper side in FIG. 1, thus, the lower side in FIG. 1 is referred to as upstream side and the upper side in FIG. 1 is referred to as downstream side.

A reference numeral 2 in FIG. 1 indicates wound roll paper. The printer apparatus 1 includes a printer cover 3 and a printer cover 3-1, and the printer cover 3 is fixed at the printer apparatus 1. The printer cover 3-1 can be opened and closed in a direction indicated by an arrow shown in FIG. 1 around a rotation shaft 4, and when the printer cover 3-1 is opened, the roll paper 2 is loaded into the printer apparatus 1 from above.

During the loading process, the loading position of the roll paper 2 is regulated by a first paper guide 5 and a second paper guide 6, and the roll paper 2 is loaded in a state of contacting with a pair of feeding rollers 7.

The roll paper 2 includes a first paper surface 8 and a second paper surface 9 opposite to the first paper surface 8, and a thermosensitive layer which generates color if heated is arranged on the first paper surface 8 only.

An idler roller 10 is supported in a rotatable manner at the downstream side of the feeding roller 7.

Further, a first conveyance guide 11 and a second conveyance guide 12 are arranged to extend from the idler roller 10 of the printer apparatus 1 towards the downstream side of the printer apparatus 1, and the space between the first conveyance guide 11 and the second conveyance guide 12 is used as a paper conveyance path 13 for conveying the roll paper 2.

At the downstream side of the idler roller 10 are arranged a thermal print head 14 and a platen roller 15 opposite to the thermal print head 14 across the paper conveyance path 13. The platen roller 15 is driven to rotate by a motor (not shown) A printing section 16 consisting of the thermal print head 14 and the platen roller 15 carries out printing on the first paper surface 8 of the roll paper 2.

A cutter 17 is arranged at the downstream side of the printing section 16.

The cutter 17 consists of a movable blade block 19 including a movable blade 18 and a fixed blade block 21 including a fixed blade 20. The movable blade block 19 and the fixed blade block are arranged opposite to each other across the paper conveyance path 13. The movable blade block 19 is fixed on the printer cover 3-1, while the fixed blade block 21 is fixed on the printer cover 3. Thus, when the printer cover 3-1 is opened around the rotation shaft 4, the movable blade block 19 is separated from the fixed blade block 21. The printer apparatus 1 further includes a paper discharge port 22 at the downstream side of the cutter 17, and the printed roll paper 2 cut by the cutter 17 is discharged to the outside of the printer apparatus 1 from the paper discharge port 22.

The printer apparatus 1 is further provided with a display section 23 which displays various states including an error situation of the printer apparatus 1. Further, a plurality of paper jam sensors (not shown) are arranged in the first conveyance guide 11 and the second conveyance guide 12 which extend from the idler roller 10 towards the paper discharge port 22. Incidentally, the description of a later-described printer cover 3-2 and a solenoid 24 is omitted in FIG. 1.

Figure 2:
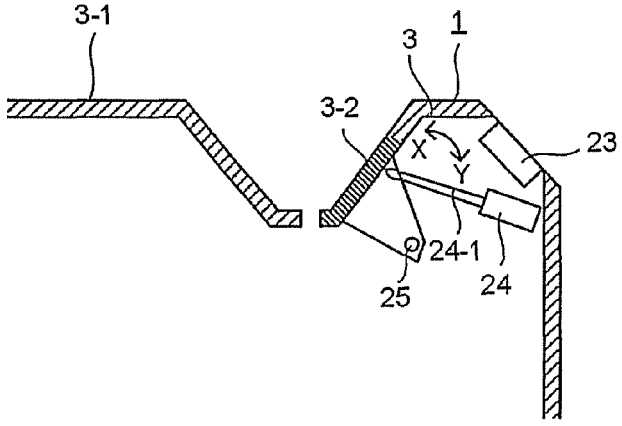
FIG. 2 is a constitution diagram illustrating the main portions of a movable cover portion of the printer apparatus according to the embodiment.

As shown in FIG. 2, the printer cover 3 is provided with a movable cover 3-2 nearby the paper discharge port 22. The movable cover 3-2 constituting one part of the printer cover 3 is connected with a solenoid arm 24-1 arranged in the solenoid 24, and is rotated in a direction indicated by an arrow shown in FIG. 2 around a cover rotation shaft 25 when the solenoid 24 is energized as stated later. In addition, for the sake of convenience of description, the cutter 17 is not shown in FIG. 2.

Figure 3:
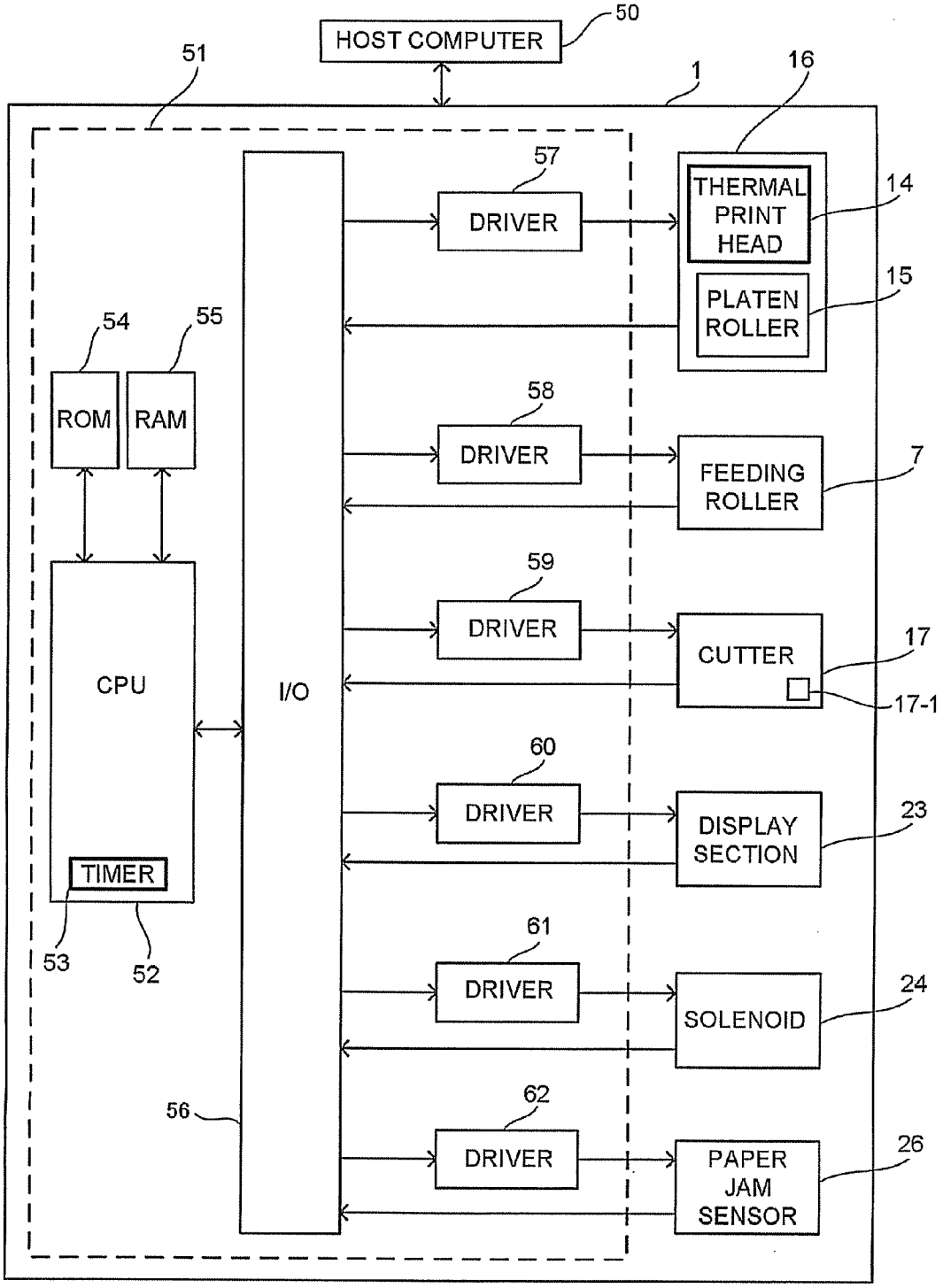
FIG. 3 is a block diagram illustrating the constitution of a control circuit of the printer apparatus according to the embodiment.

FIG. 3 is a block diagram illustrating the constitution of a control circuit of the printer apparatus 1 according to the present embodiment. A control section 51 controls the paper conveyance, printing, paper cutting, paper discharging, paper jam detection, movable cover rotation and the display of the situation of the printer.

The control section 51 is formed by, for example, a microcomputer which connects with a host computer 50 and carries out various controls. A central processing unit (CPU) 52 of the control section 51 carries out, according to a program, various operations and controls such as a paper conveyance control, a printing control, a paper cutting control, a paper discharging control and a movable cover rotation control according to the detection of paper jam.

Further, the CPU 52 comprises a timer 53 serving as a module for setting and controlling time.

A ROM 54 and a RAM 55 are arranged in the control section 51 as primary storage modules for storing the control programs executed by the CPU 52 and the data generated during a control or an operation process.

The ROM 54 is a read-only memory in which control programs and tables are stored, and the RAM 55 is a random access memory for storing the data generated during an operation process and the like.

Further, an input/output unit (I/O) 56 is arranged in the control section 51 to acquire various input data from the host computer 50 and extract a control output of the control section 51 to the host computer 50. The I/O 56 is connected with the CPU 52, the ROM 54 and the RAM 55 via a bus line.

The I/O 56 is connected with a first, a second, a third, a fourth, a fifth and a sixth drivers 57, 58, 59, 60, 61 and 62 serving as modules for extracting a control output.

The first driver 57 supplies a required drive output for the printing section 16. The second driver 58 supplies a required drive output for the feeding roller 7. The third driver 59 supplies a required drive output for the cutter 17 and supplies a required drive output for a home position sensor 17-1 arranged in the cutter 17. The fourth driver 60 supplies a display drive output for the display section 23 to enable the display section 23 to execute various displays. The fifth driver 61 supplies a drive output for the solenoid 24. The sixth driver 62 supplies a required drive output for the paper jam sensor 26.

When carrying out printing on the roll paper 2 by the printing section 16, the platen roller 15 is rotationally driven by a motor in synchronization with the printing operation based on a control output serving as a printing instruction module of the CPU 52. The thermal print head 14 generates heat and carries out printing on the first paper surface 8 of the roll paper 2 based on the printing data from the host computer 50.

The CPU 52 of the control section 51 rotates the feeding roller 7 and stops the rotation of the feeding roller 7 through the driver 58.

The CPU 52 of the control section 51 drives the cutter 17 through the driver 59 to cut the roll paper 2.

The CPU 52 of the control section 51 displays various kinds of information, errors and the like of the printer apparatus 1 on the display section 23 through the driver 60.

The CPU 52 of the control section 51 drives the solenoid 24 through the driver 61.

The CPU 52 of the control section 51 acquires paper jam information from the paper jam sensor 26 through the driver 62.

The operations of the printer apparatus 1 are described below with reference to FIG. 1, FIG. 2 and FIG. 4-FIG. 7. The control section 51 carries out paper conveyance and printing operation according to the programs stored in the ROM 54.

First, an operator rotates the printer cover 3-1 arranged in the printer apparatus 1 around the rotation shaft 4 to open the upper portion of the printer apparatus 1 to load the roll paper 2 into the printer apparatus 1 from above. During the loading process, the loading position of the roll paper 2 is regulated by the first paper guide 5 and the second paper guide 6, and the roll paper 2 is loaded in a state of contacting with the feeding rollers 7.

Next, the roll paper 2 is drawn to pass through the idler roller 10 and then set in such a state in which the front end thereof is positioned between the thermal print head 14 and the platen roller 15, and then the printer cover 3-1 is closed.

Figure 4:
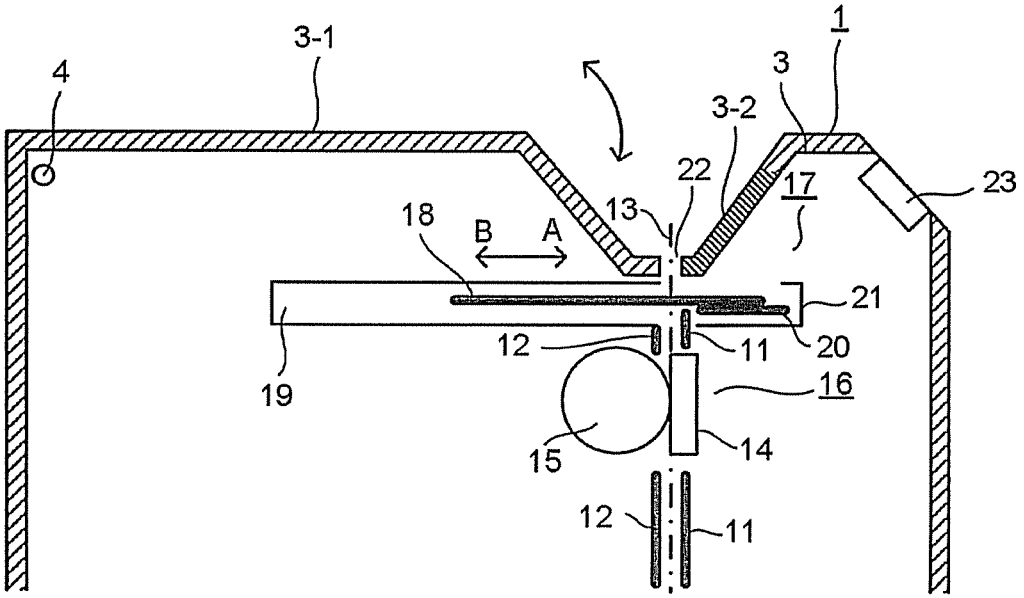
FIG. 4 is a constitution diagram illustrating the main portions in a cutter operation state of the printer apparatus according to the embodiment.

The printer apparatus 1, if receiving the printing data from the host computer 50 in this state, rotates the feeding rollers 7 and the platen roller 15 to convey the roll paper 2 towards the downstream side. During the paper conveyance process, the thermal print head 14 is driven to carry out printing on the first paper surface 8. After the pre-determined printing is carried out on the first paper surface 8, the control section 51 sends a driving signal to the cutter 17. The cutter 17, if receiving the driving signal, slides the movable blade 18 towards the fixed blade 20 in a direction A as shown in FIG. 4 through a sliding mechanism (not shown) to cut the roll paper 2 through the cooperation of the movable blade 18 and the fixed blade 20. The cut roll paper 2 is discharged to the outside of the printer apparatus 1 from the paper discharge port 22. After the cutting of the roll paper 2 is completed, the movable blade 18 is slid in a direction B to return the movable blade 18 to a home position. The position of the movable blade 18 shown in FIG. 1 is the home position of the movable blade 18, and whether or not the movable blade 18 is returned to the home position is detected by the home position sensor 17-1 (not shown) arranged in the cutter 17.

Figure 5:
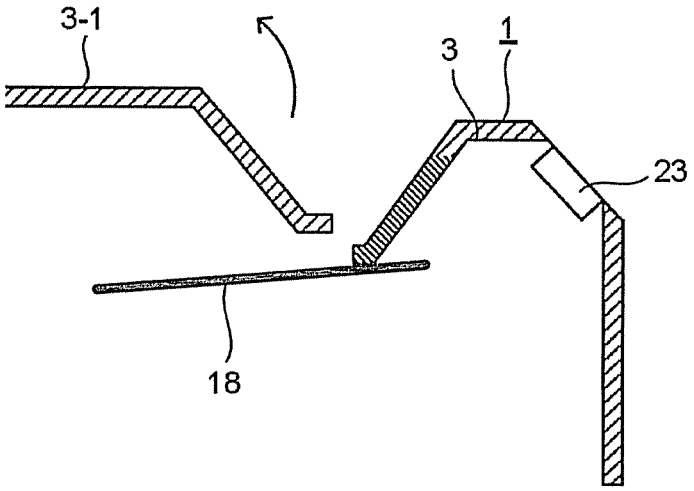
FIG. 5 is a diagram illustrating a state in which a movable blade is contacted with a printer cover according to the embodiment.

On the other hand, there is a case in which the roll paper 2 is not cut successfully due to the poor cutting by the cutter 17 and the movable blade 18 is stopped as a paper jam error in a state of protruding towards the fixed blade 20. In a case of releasing the paper jam error, the printer cover 3-1 is rotated around the rotation shaft 4 to open the upper portion of the printer apparatus 1 to remove the roll paper 2 which is not cut successfully. However, if the printer cover 3-1 is rotated in a state in which the movable blade 18 protrudes towards the fixed blade 20, as shown in FIG. 5, the movable blade 18 is contacted with the printer cover 3, which may cause damage in the movable blade 18. To prevent such a problem, one part of the printer cover 3 is rotated as the movable cover 3-2 to prevent the contact with the movable blade 18.

Figure 6:
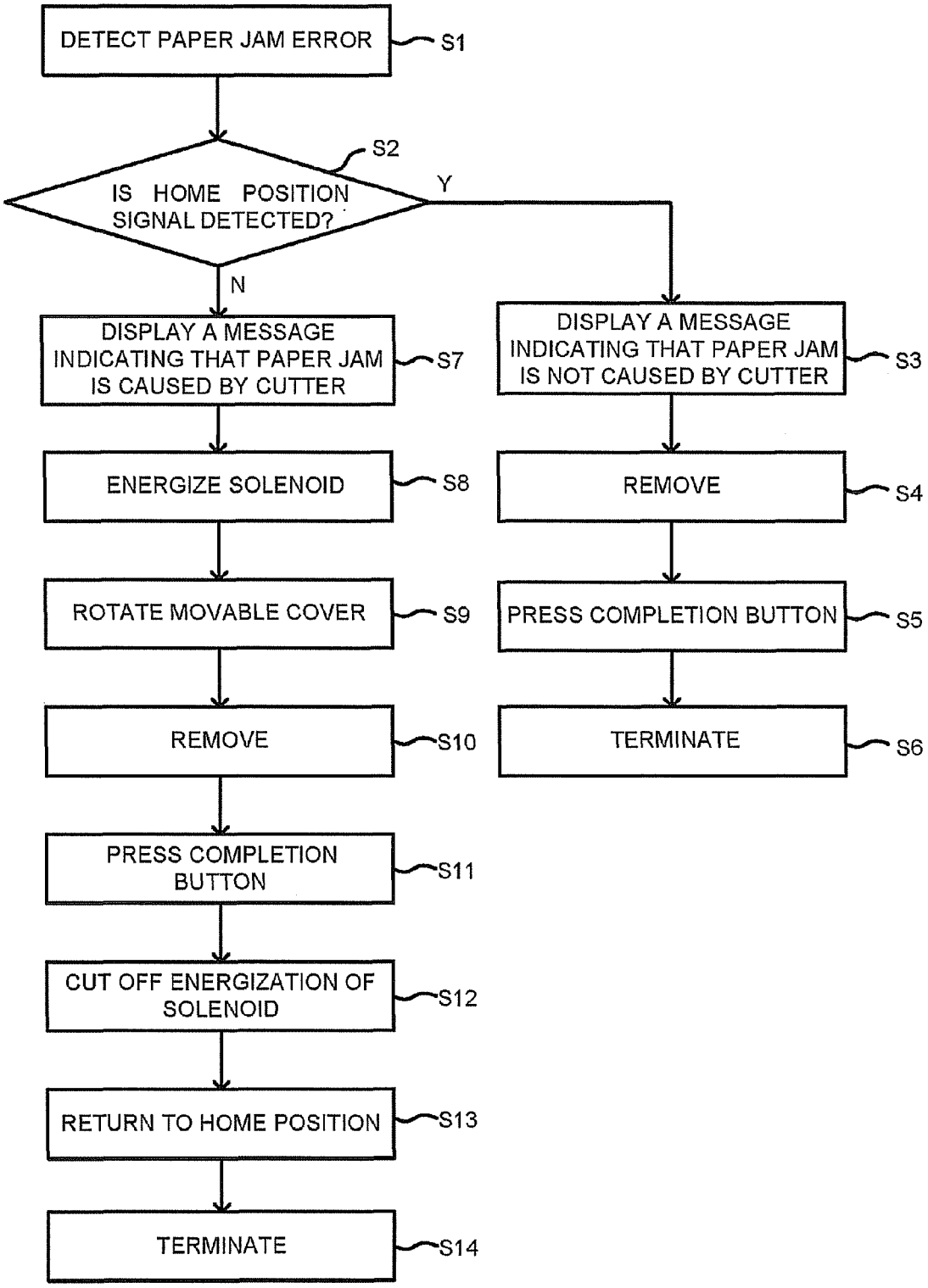
FIG. 6 is a flowchart illustrating a procedure from paper jam error detection to paper jam error removing of the printer apparatus according to the embodiment.
Figure 7:
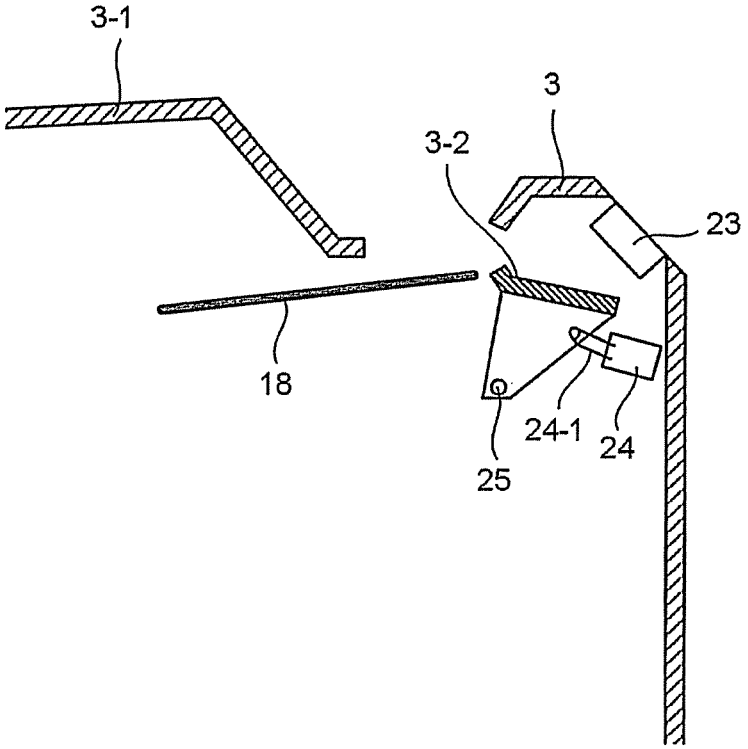
FIG. 7 is a diagram illustrating the position of the movable cover which avoids the contact with the movable blade according to the embodiment.

Hereinafter, the rotation of the movable cover 3-2 after the paper jam error is detected is described with reference to FIG. 6 and FIG. 7.

The control section 51, after detecting the paper jam error by the paper jam sensor 26 (S1), confirms whether or not a signal of the home position sensor 17-1 arranged in the cutter 17 is detected (S2). The home position sensor 17-1 detects whether or not the movable blade 18 of the cutter 17 is positioned at the home position shown in FIG. 1, and generally issues an ON signal if the movable blade 18 is positioned at the home position.

The paper jam error is caused not only by the poor cutting by the cutter 17 but also by the paper jam on the paper conveyance path 13. In a case in which the paper jam error is not caused by the poor cutting by the cutter 17, the movable blade 18 is not stopped in a state of protruding towards the fixed blade 20, thus, there is no need to rotate the movable cover 3-2 in this case. In a case in which the home position error signal is detected (YES in S2), the paper jam error is not caused by the poor cutting by the cutter 17, thus, a message indicating that the paper jam is not caused by the poor cutting by the cutter 17 is displayed on the display section 23 (S3). The operator of the printer apparatus 1 rotates the printer cover 3-1 to open the upper portion of the printer apparatus 1 and then removes the roll paper 2 that causes the paper jam from the printer apparatus 1 (S4). Then the operator closes the printer cover 3-1. Next, the operator presses an error-removing completion button (not shown) arranged in the printer apparatus 1 (S5). If the error-removing completion button is pressed, the printer apparatus 1 is capable of carrying out the following printing, and the error-removing processing is terminated (S6). It is exemplified that the error-removing completion button (not shown) is pressed after the removing of the roll paper 2 that causes the paper jam is completed; however, it is not limited to this. For example, a cover open switch (not shown) may be arranged, and if the cover open switch detects that the printer cover 3-1 is closed after the removing completion of the roll paper 2 that causes the paper jam, it can be recognized that the error-removing is completed.

It is confirmed whether or not the signal of the home position sensor 17-1 is detected (S2), and in a case in which the signal is not detected (NO in S2), a message indicating that the paper jam is caused by the poor cutting by the cutter 17 is displayed on the display section 23 (S7), and then the control section 51 energizes the solenoid 24 (S8). As shown in FIG. 2, the part of the printer cover 3 is cut and the movable cover 3-2 is arranged. Further, the movable cover 3-2 is connected with the solenoid 24 through the solenoid arm 24-1. The movable cover 3-2, which can be rotated in directions X and Y shown in FIG. 2 around the rotation shaft 25, is generally energized in the direction X by an energization member (not shown).

If the solenoid 24 is energized (S8), the solenoid arm 24-1 is pulled towards the side of the solenoid 24, and in this way, the movable cover 3-2 is rotated in the direction Y around the rotation shaft 25 against the energization force (not shown) in the direction X (S9). Next, the operator rotates the printer cover 3-1 around the rotation shaft 4 to open the upper portion of the printer apparatus 1 to remove the roll paper 2 which is not cut successfully (S10). The open state of the printer cover 3-1 at this time is shown in FIG. 7. As shown in FIG. 7, the printer cover 3-1 at the position where it is contacted with the movable blade 18 is rotated corresponding to the movable cover 3-2, which prevents the contact with the movable blade 18. In this way, it is possible to prevent the damage caused by the contact of the movable blade 18 with the printer cover 3-1.

The jammed roll paper 2 is removed (Sb), and then the printer cover 3-1 is closed. Next, the operator presses the error-removing completion button (not shown) arranged in the printer apparatus 1 (S11). If the error-removing completion button is pressed, the control section 51 cuts off the energization of the solenoid 24 (S12). If the energization of the solenoid 24 is cut off, the pulling force in the direction Y generated by the solenoid 24 in FIG. 2 disappears. In this way, the movable cover 3-2 returns to the position shown in FIG. 2 under the energization force in the direction X generated by the energization member (not shown). Next, the control section 51 sends the driving signal to the cutter 17 to slide the movable blade 18 in the direction B shown in FIG. 4 by the sliding mechanism (not shown) of the cutter 17 to return the movable blade 18 to the home position shown in FIG. 1 (S13). In this way, the printer apparatus 1 is capable of carrying out the following printing, and the error-removing processing is terminated (S14).

As stated above, in accordance with the present embodiment, when paper jam occurs in the printer apparatus 1, it is detected whether or not the movable blade 18 for cutting the roll paper 2 is positioned at the home position where it does not protrude towards the fixed blade 20, and if it is determined that the movable blade 18 is not positioned at the home position, the solenoid 24 is energized to rotate the movable cover 3-2 constituting one part of the printer cover 3. In this way, it is possible to prevent the movable blade 18 from being contacted with the printer cover 3 even if the printer cover 3-1 is opened to remove the paper jam in a state in which the movable blade 18 protrudes towards the fixed blade 20, which can prevent the movable blade 18 from being damaged due to the contact of the movable blade 18 with the printer cover 3. Further, the movable cover 3-2 is rotated around the rotation shaft 25. In this way, it is possible to return the movable cover 3-2 to the original position easily.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer apparatus comprising:

a main body configured to include a first printer cover;

an opening and closing unit configured to include a second printer cover which is fixed to be rotatable with respect to the main body;

a fixed blade configured to be held by the main body;

a movable blade configured to be held by the opening and closing unit to cut paper through the cooperation with the fixed blade;

a paper sensor configured to detect paper jam of the paper;

a home position sensor configured to detect a home position of the movable blade;

a third printer cover configured to constitute one part of the first printer cover, and retract to a retracting position so as not to contact with the movable blade which is not positioned at the home position when the opening and closing unit is opened; and a control section configured to control to automatically rotate and retract the third printer cover to the retracting position in a case in which the paper sensor detects the paper jam of the paper, and the home position sensor detects that the movable blade is not positioned at the home position.

2. The printer apparatus according to claim 1, wherein the third printer cover is rotated around a rotation shaft.

3. The printer apparatus according to claim 2, wherein the third printer cover is rotated by a solenoid.

4. The printer apparatus according to claim 1, wherein the control section control to return the movable blade to the home position after removing the paper of the paper jam.

* * * * *